US006363238B1

(12) United States Patent
Spencer et al.

(10) Patent No.: US 6,363,238 B1
(45) Date of Patent: Mar. 26, 2002

(54) SUBSTRATE CONDITIONER SEAL USING DIFFERENTIAL AIR PRESSURE

(75) Inventors: Stan Alan Spencer, Rochester; Jack G. Elliot, Penfield, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/808,772

(22) Filed: Mar. 16, 2001

Related U.S. Application Data

(60) Provisional application No. 60/257,814, filed on Dec. 21, 2000.

(51) Int. Cl.[7] ..... G03G 15/00
(52) U.S. Cl. ..... 399/406; 399/341
(58) Field of Search ..... 118/246; 399/239, 399/249, 231, 406

(56) References Cited

U.S. PATENT DOCUMENTS

| | | | | |
|---|---|---|---|---|
| 5,434,029 | A | 7/1995 | Moser | 430/97 |
| 5,930,578 | A | 7/1999 | Hwang | 399/406 |
| 5,937,258 | A | 8/1999 | Acquaviva et al. | 399/341 |
| 5,987,301 | A | 11/1999 | Acquaviva | 399/406 |
| 6,249,667 | B1 * | 6/2001 | Acquaviva et al. | 399/406 |

* cited by examiner

*Primary Examiner*—Arthur T. Grimley
*Assistant Examiner*—Hoang Ngo
(74) *Attorney, Agent, or Firm*—William Eipert

(57) ABSTRACT

A fluid sealing device for sealing liquid within a conditioning system wherein the liquid is supplied through a fluid supply hose to a fluid reservoir defined by the area of contact between a transfer roll and a metering device which controls the amount of fluid supplied to the transfer roll. The sealing device includes a nozzle positioned at an end of the fluid reservoir to generate a first pressure at the end of the fluid reservoir.

23 Claims, 4 Drawing Sheets

FIG. 3
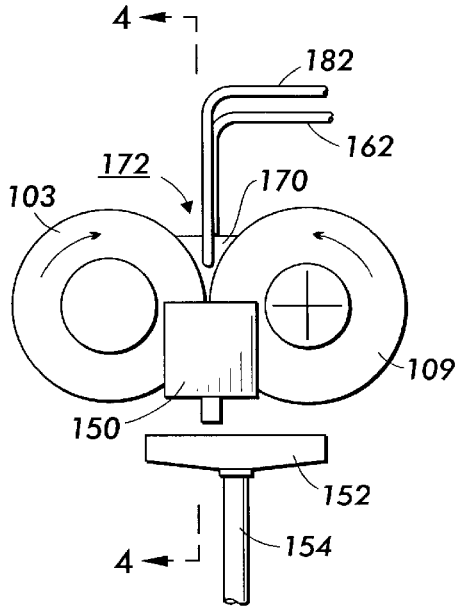
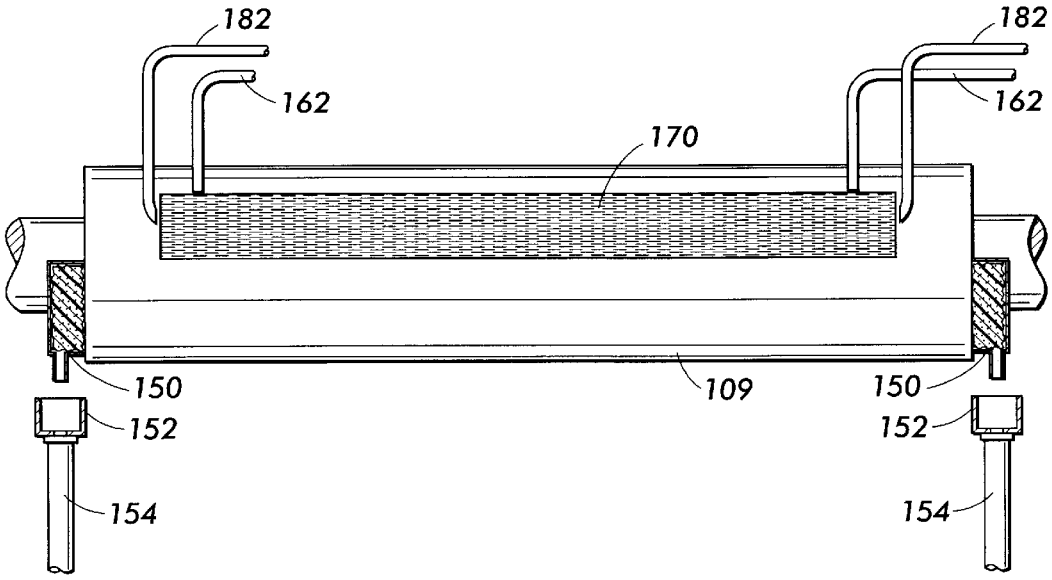
FIG. 4

FIG. 5
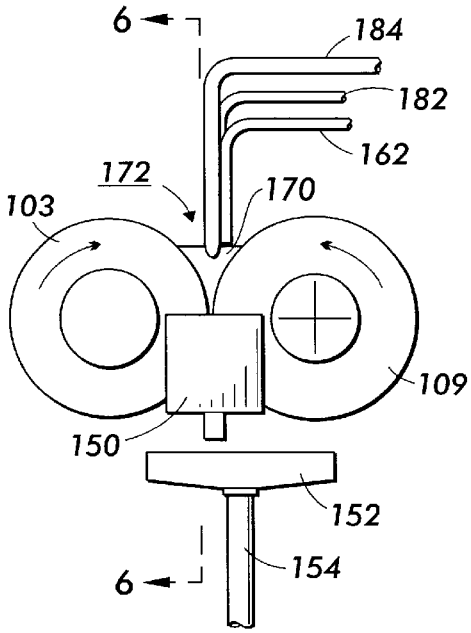
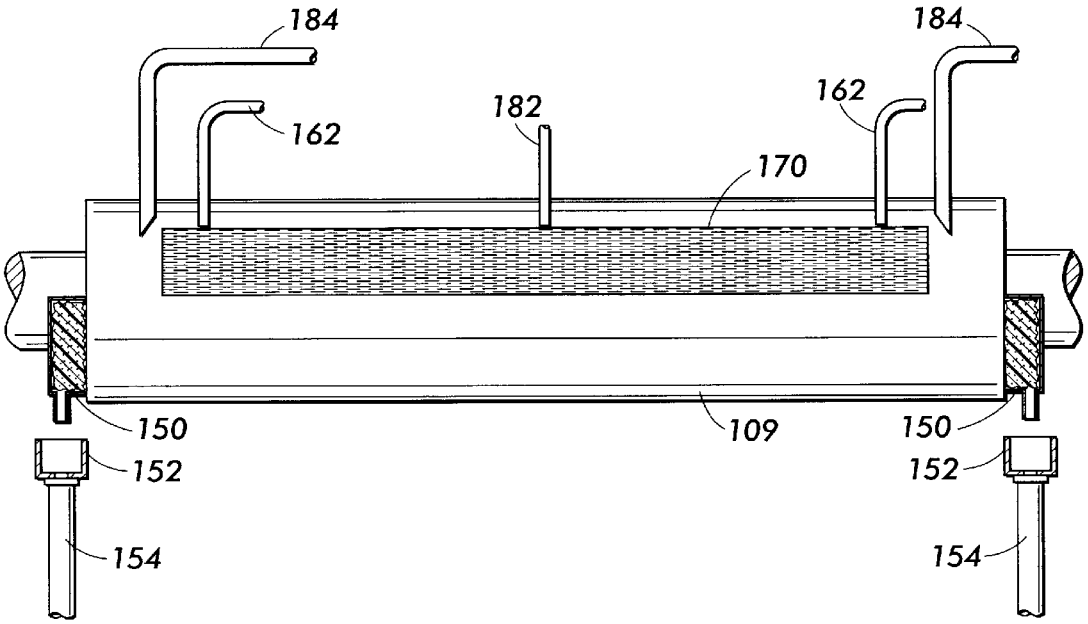
FIG. 6

SUBSTRATE CONDITIONER SEAL USING DIFFERENTIAL AIR PRESSURE

Priority is claimed from Provisional Application No. 60/257,814, filed Dec. 21, 2000.

BACKGROUND OF THE INVENTION

This invention relates generally to a substrate conditioning device for an electrophotographic printing machine and, more particularly, concerns an improvement for eliminating water spills from the ends of moisturizing rolls in the conditioning device.

In a typical electrophotographic printing process, a toner powder image is then transferred from a photoconductive member to a print sheet. In order to fix or fuse electroscopic toner material onto the print sheet by heat and pressure, it is necessary to apply pressure and elevate the temperature of the toner to a point at which the constituents of the toner material become tacky and coalesce. This action causes the toner to flow to some extent into the fibers or pores of the support mediumprint sheet (typically paper). Thereafter, as the toner material cools, solidification of the toner material occurs, causing the toner material to be bonded firmly to the support member.

One approach to heat and pressure fixing of electroscopic toner images onto a support has been to pass the print sheet bearing the toner images between a pair of opposed roller members, at least one of which is internally heated. During operation of a fixing system of this type, the print sheet to which the toner images are electrostatically adhered is moved through the nip formed between the rolls and thereby heated under pressure. A large quantity of heat is applied to the toner and the print sheet bearing the toner image. This heat evaporates much of the moisture contained in the sheet.

After the print sheet passes through the fuser, it cools and regains moisture from the environment. The substrate (e.g., paper) tends to regain a significant amount of the moisture lost while the toner regains little if any. Furthermore, as the toner cools, it contracts thereby pulling the sheet toward it, further increasing curl. Toner has a much larger coefficient of thermal expansion and a much smaller coefficient of hydro expansion than paper. Differences in the amount of toner on the different sides (e.g., a high area coverage simplex print) will cause the sheet to curl. That is, post fusing the toner contracts while the paper expands causing the print to curl, the degree of curl depends on the relative thickness of the toner layer.

A number of solutions to this print curl problem have been advanced. One proposed solution is to use conditioning rollers to add moisture to each sheet as it exits the system. This can be effected by passing the print sheet (substrate) through a nip formed by two pressure engaged rolls, a transfer roll and a backing roll. The transfer roll applies a wetting agent to the substrate as the substrate passes through the nip. These systems typically employ a metering roll to deliver evenly metered wetting agent (e.g., water) to the transfer roll which creates a wetted nip at the interface of the metering and transfer rolls.

One of the biggest problems encountered with conditioning devices is the sealing the wetting agent within the nip at the interface of the metering and transfer rolls to prevent water leakage from the rolls. When the wetting agent, which is supplied to the rolls continuously, leaks off the edge of the rolls, it creates a thick, non-uniformly metered section of agent on the transfer roll which then gets transferred to the substrate. This thick section of wetting agent then gets transferred to the substrate resulting in cockle or non-uniform curl. Thus, it is desired to provide a system to contain the wetting agent within the wetted nips and prevent leakage from the ends of the rolls.

The following disclosures may be relevant to various aspects of the present invention:

U.S. Pat. No. 5,987,301 to Acquaviva discloses a paper conditioner that includes a pump, supply lines, overflow lines, metering blade lines and return lines. A soaker hose is used to uniformly distribute conditioner agent to a wick. The soaker hose has pin-holes that are evenly spaced adjacent the wick. The wick is a high density material, such as, cotton that contacts and supplies the conditioner agent to metering rolls. These rolls contact donor rolls, which contact moisturizing rolls which contact the paper. Metering blades are used to remove excess conditioning agent from the moisturizing rolls.

U.S. Pat. No. 5,937,258 to Acquaviva et al uses one or more counter-rotating transfer rollers which are initially spaced from their respective back-up rollers in the intercopy gap, and which come together as the lead edge enters the nip area, and separates when the trail edge is about to pass. This permits the rollers to have a less demanding run out tolerance by bringing the rollers together when the sheet is in the nip, and then articulating the rollers apart in the intercopy gap.

U.S. Pat. No. 5,930,578 to Hwang discloses a paper conditioner to control image dependent curl in a copier/printer. The conditioner employs metering and transfer rolls which form a nip and have grooves positioned on the end portions of both rolls. Portions of both the metering and transfer rolls are located over a sump connected to a reservoir that supplies liquid to the nip. The grooves act as gutters and allow excess liquid to flow into the sump and subsequently back into the reservoir.

U.S. Pat. No. 5,434,029 to Moser describes an apparatus and method of preventing the curling of a substrate that has been subjected to heat for the purpose of fixing toner images to the substrate. Simultaneous constraint of the copy substrate and the application of moisture thereto is effected by passing the substrate through the nip formed by two pressure engaged rollers, one of which is utilized for applying the water to the back side of the substrate as the substrate passes through the aforementioned nip.

SUMMARY OF THE INVENTION

In accordance with one aspect of the present invention, there is provided a device for controlling leakage of liquid from a conditioning assembly. The device includes a transfer roll, for applying liquid to a side of a sheet, the transfer roll having an outer cylindrical surface; a metering roll, having an outer cylindrical surface in contact with the transfer roll, to control the flow of liquid to the transfer roll, the transfer and metering rolls being aligned with respect to one another along their axes so as to define a nip between the outer cylindrical surfaces; a supply pump to supply liquid to the nip; and a nozzle, positioned near an end of one of the transfer roll and the metering roll, generating an air pressure at the roll end.

Pursuant to another aspect of the present invention, there is provided a printing machine of the type wherein a sheet having indicia printed thereon advances through a conditioning system. The conditioning system includes: a pair of generally cylindrical rolls, the rolls being aligned with respect to one another along their axes so as to define a conditioner nip between the outer cylindrical surfaces, the pair of generally cylindrical rolls including a first roll adapted to drive a sheet in a first direction through the conditioner nip and a second roll, adapted to apply a liquid to a side of the sheet opposite the side that contacts the first roll, wherein the second roll rotates in a direction opposite the direction of the first roll; a metering roll in contact with one roll of pair of generally cylindrical rolls for forming a fluid nip therewith and controlling the amount of liquid supplied to the one of the rolls; a supply pump to supply liquid to the fluid nip; and an aperture, positioned near an end of the fluid nip, to generate a pressure differential between the end of the nip and an interior of the nip.

Pursuant to yet another aspect of the present invention, there is provided a method of controlling the amount of liquid within a nip formed between a metering roll and a transfer roll. The method includes supplying liquid to the nip and generating an air pressure at an end of the nip, the air pressure at the end of the nip being different than an air pressure at an interior of the nip.

Pursuant to yet another aspect of the present invention, there is provided a fluid sealing device for a system for supplying a measured amount of liquid to a transfer roll wherein the liquid is supplied to a fluid reservoir defined by the area of contact between the transfer roll and a metering device through a fluid supply hose, the metering device controlling the amount of fluid supplied to the transfer roll. The fluid sealing device comprising a nozzle positioned at an end of the fluid reservoir wherein the nozzle generates a pressure at the end of the fluid reservoir.

BRIEF DESCRIPTION OF THE DRAWINGS

Other features of the present invention will become apparent as the following description proceeds and upon reference to the drawings, in which:

FIG. 3 shows an end view an embodiment of a conditioner roll air seal device according to the present invention;

FIG. 4 shows a sectional view of a conditioner roll air seal taken along line 4—4 of FIG. 3;

FIG. 5 shows a end view of an alternate embodiment of a conditioner roll air seal device according to the present invention; and FIG. 6 shows a sectional view of a conditioner roll air seal taken along line 6—6 of FIG. 5.

DETAILED DESCRIPTION OF THE INVENTION

Figure 1:
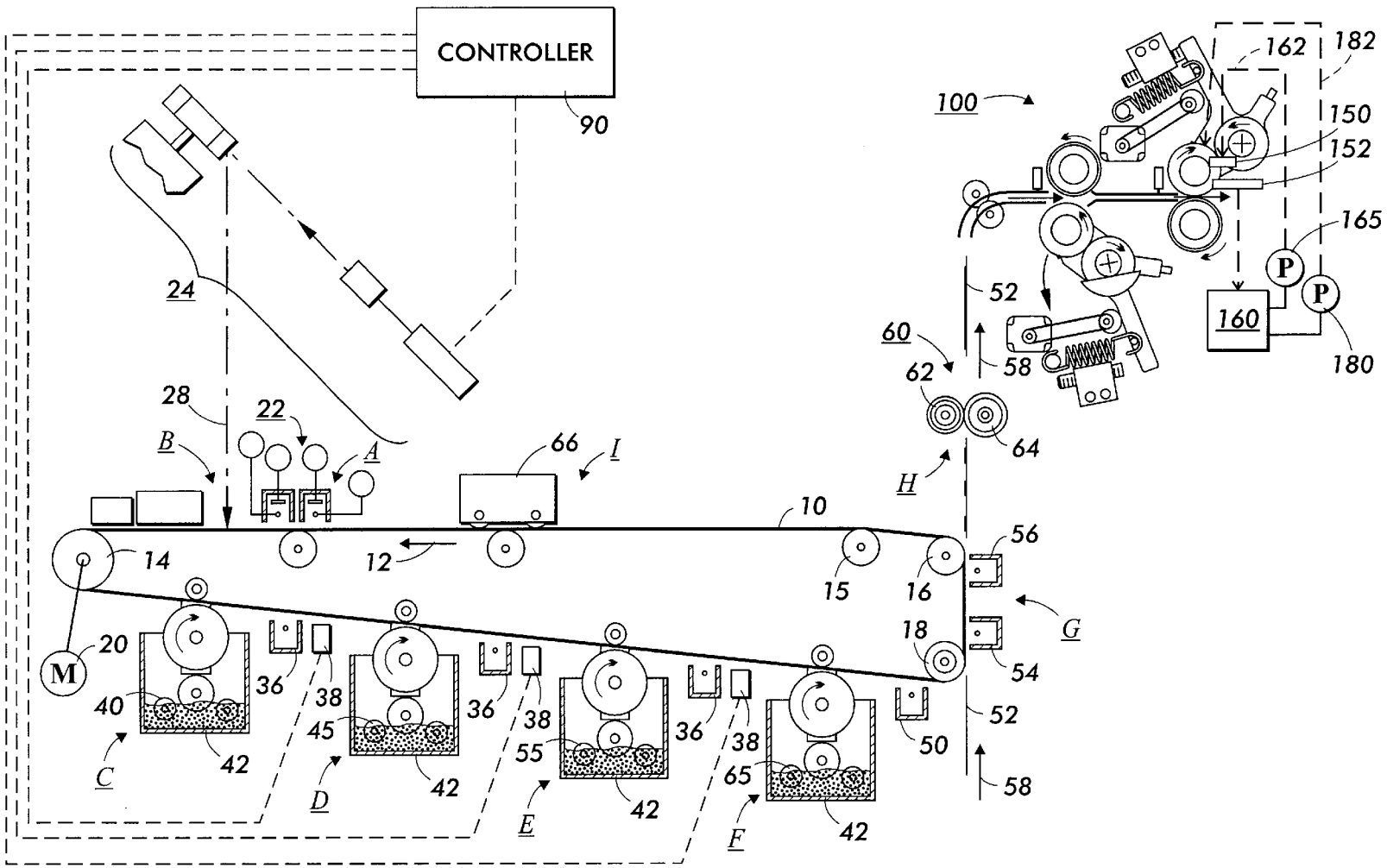
FIG. 1 is a schematic, elevational view of a full color electrophotographic printing machine utilizing the apparatus described herein.

The following will be a detailed description of the drawings illustrating the present invention. In this description, as well as in the drawings, like referenced numbers represent devices, circuits, or equivalent circuits which perform the same or equivalent functions. While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Turning now to FIG. 1, there is shown a printing machine which incorporates the features of the present invention. The printing machine uses a charge retentive surface in the form of a photoreceptor belt 10 supported for movement in the direction indicated by arrow 12, for advancing sequentially through the various xerographic process stations. The belt is entrained about a drive roller 14 and tensioning rollers 16 and 18. Belt travel is brought about by rotating drive roller 14 via motor 20 coupled thereto.

As belt 10 moves each part of it passes through each of the process stations described below. For convenience, a single section of photoreceptor belt 10, referred to as the image area, is identified. The image area is that part of photoreceptor belt 10 which receives the toner powder images that, after being transferred to a substrate, produce the final image. Photoreceptor belt 10 may have numerous image areas, each of which is processed in the same way.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential. Next, the charged portion of photoconductive surface is advanced through an imaging/exposure station B.

Upon passing through charging station A, the charged image area travels through a first imaging/exposure station B. At imaging/exposure station B, a controller, indicated generally by reference numeral 90, receives the image signals representing the desired output image and processes these signals to convert them to the various color separations of the image which is transmitted to a laser based output scanning device 24 which generates a modulated light beam 28. Modulated light beam 28 illuminates portions of the image area which causes the charge retentive surface to be discharged in accordance with the output from the scanning device so as to create an electrostatic latent image. Preferably the scanning device is a laser Raster Output Scanner (ROS). Alternatively, the ROS could be replaced by other xerographic exposure devices such as LED arrays.

After receiving an electrostatic latent image at station B, the now exposed image area passes through a first development station C having a developer structure 42 at which toner 40 of a first color (e.g., black) is placed on the latent image using commonly known techniques such as magnetic brush development, scavangeless development, or the like. Assuming development station C is a hybrid jumping development (HJD) system, a development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles to be attracted to the electrostatic latent image. Appropriate developer biasing is accomplished via a power supply. This type of system is a noncontact type in which there is no mechanical contact between the photoreceptor and a toner delivery device to disturb a previously developed, but unfixed, image.

After passing through development station C, the now exposed and toned image area passes to a corona recharge device 36 having a high output current vs. control surface voltage (I/V) characteristic slope is employed for bringing the voltage level of both the toned and untoned areas on the photoreceptor to a substantially uniform level.

After being recharged at recharging station 36, the now substantially uniformly charged image area with its first toner powder image passes to a second exposure/imaging station 38. Station 38 is similar to exposure station B (i.e., a laser based output structure for selectively discharging the photoreceptor) except that exposure station 38 illuminates the image area with a light representation of a second color image (such as yellow) to create a second electrostatic latent image. At this point, the photoreceptor contains toned and untoned areas at relatively high voltage levels and toned and untoned areas at relatively low voltage levels.

After being exposed at station 38 the image area passes to a second development station D. At development station D toner 45 which is of a different color (e.g., yellow) than the toner in development station C is advanced onto the second latent image. Toner 45 which is contained in developer housing 42 beneficially is advanced onto the latent image by a noncontact developer in which there is no mechanical contact between the photoreceptor and a toner delivery device to disturb a previously developed, but unfixed, image. After passing through development station D, the image area has first and second toner powder images which may overlap.

The above recharge, exposure and development procedure is repeated for a third suitable color toner 55 such as magenta at station E and for a fourth suitable color toner 65 such as cyan at station F. In this manner a full color composite toner image is developed on the photoreceptor belt.

To condition the toner for effective transfer to a substrate, the image area then passes to a pre-transfer corotron device 50 which delivers negative corona to ensure that all toner particles are of the required negative polarity. After passing pre-transfer device 50, the four toner powder images are transferred from the image area onto a support sheet 52 at transfer station G. It is to be understood that support sheet 52 is advanced to the transfer station in the direction of arrow 58 by a conventional sheet feeding apparatus (not shown).

Transfer station G includes a transfer corona device 54 which sprays positive ions onto the backside of sheet 52. This causes the negatively charged toner powder images to move onto sheet 52. Transfer station G also includes a detack corona device 56 which facilitates the removal of support sheet 52 from belt 10 after image transfer.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute guides the advancing sheets 52 to substrate conditioner 100 and then to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

Figure 2:
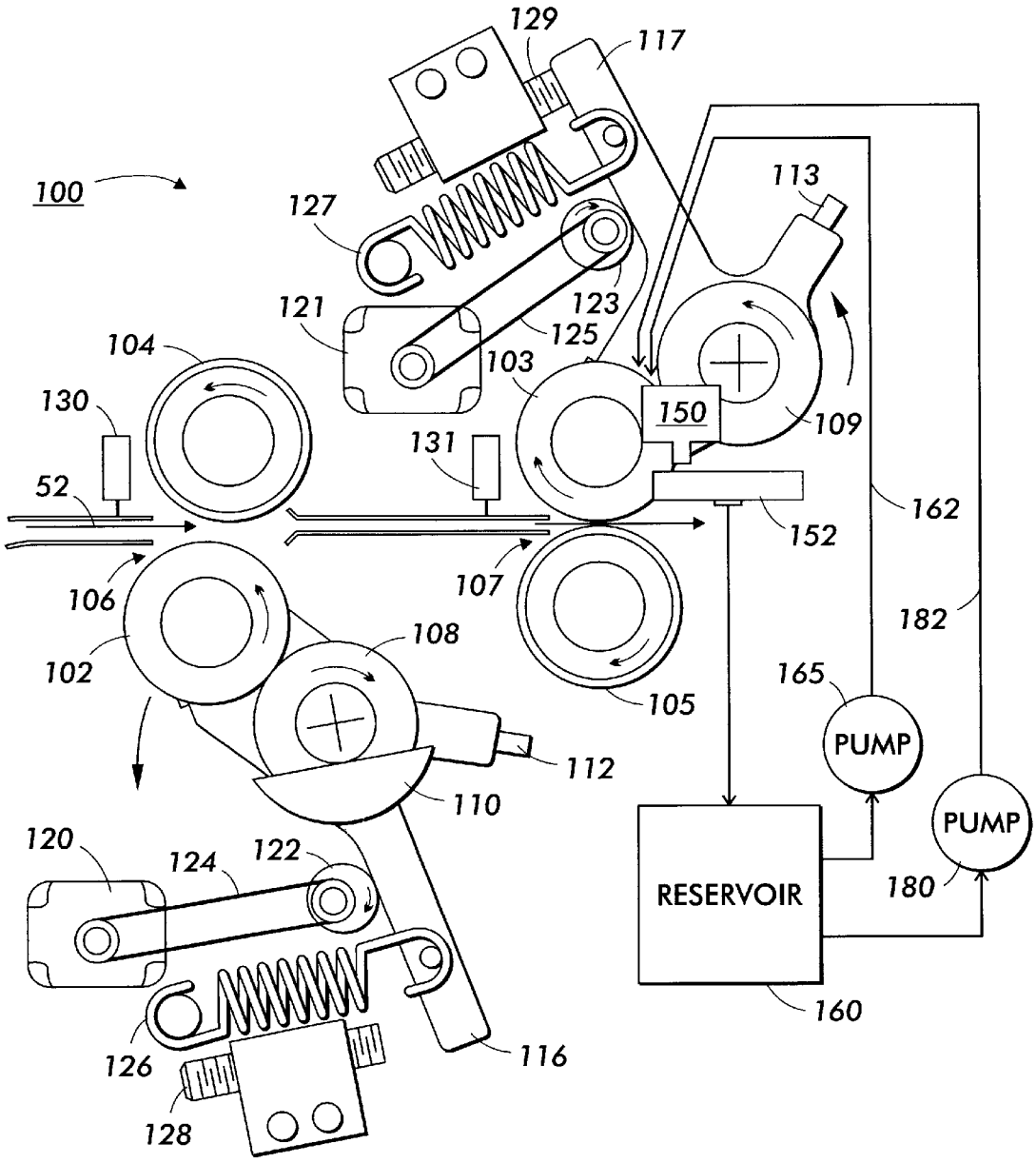
FIG. 2 shows a sheet conditioner in accordance with the teachings of the present invention.

As shown in FIG. 2, the sheet conditioning device, generally referred to as reference numeral 100, has transfer rolls 102, 103 which are articulated in an almost vertical direction, such that when the lead edge of incoming sheets 52 enter nip areas 106, 107, transfer rolls 102, 103 move towards sheet 52 to engage the rotating back-up rolls 104, 105 which are in a fixed position. Likewise, when the trail edge of the sheet is about to exit the nips 106, 107, transfer rolls 102, 103 move away from sheet 52 to disengage back-up rolls 104, 105. Springs 126, 127 provide the normal force for transfer rolls 102, 103 against back up rollers 104, 105. Since the back-up rolls 104, 105 are rubber coated, a thick or thin sheet will deflect the rubber surface and provide the necessary drive force. The nips 106, 107 are disengaged in the intercopy gap, by say 0.015", and there is no danger that the back-up rolls 104, 105 will be wet.

Referring to the upper transfer roll 103/metering roll 109 assembly, the wetting agent, in this case water to which a surfactant may be added, if desired, is distributed to transfer roll 103/metering roll 109 from reservoir 160 through tube 162 using pump 165. Although shown as including a single metering roll, it is well known in the art that the device may include more than one metering roll to control the amount of fluid applied to the transfer roll. Similarly, a metering blade may be employed as an alternative to a metering roll. The contact between the metering rolls 108, 109 and the transfer rolls 102, 103 can be adjusted by using adjuster screws 112, 113 which can be manually adjusted as shown, or the adjusters 112, 113 can be driven by a motor (not shown) or other device to provide automatic adjustment depending on the desired film thickness on the transfer roller.

A sensor 130 located upstream of the first moisturizing nip 106, detects lead and trail edge sheet position and provides the necessary timing to close and open the nips 106, 107. For example, if the sheet velocity when it is at the sensor 130, and the distance from the sensor 130 to each moisturizing nip 106, 107 are known, and the velocity between nips and sheet velocity in each nip is known, then it is a relatively simple algorithm to determine when to engage and disengage each nip. Alternately, a second sensor 131 can be used between the nips 106, 107 to assist in determining the proper sequencing of the nip engagement/disengagement.

There is illustrated only one of many methods of separating the nips 106, 107. In FIG. 2, there is shown two stepper motors 120, 121 driving two cams 122, 123. As each cam 122, 123 rotates in the clockwise direction, it separates the respective transfer roller 102, 103 from the respective back-up roller 104, 105. In the position illustrated by the cam 122, the nip 106 may be separated by 0.015". When the cams are in the position illustrated by cam 123, the cam surface is not touching the pivot arm 117, but the contact dimension is determined by the adjustment screw 129. A similar screw 128 is provided for arm 116. This scheme uses two stepper motors 120, 121 driving cams 122, 123 through drive members 124, 125. Alternate methods might employ solenoids, clutches, cables etc. Likewise, alternate methods might articulate the back-up rollers 104, 105 instead of the transfer rollers 102, 103.

Referring now to FIGS. 3 and 4 there is shown an embodiment of a conditioner roll seal in accordance with the present invention employed with the upper transfer roll 103/metering roll 109 assembly to insure that the wetting agent is prevented from dripping onto the sheet and producing undesirable wetting characteristics. The embodiment of FIGS. 3 and 4 uses a differential pressure between the ends of the nip and the interior region of the nip area created by a nozzle or similar aperture generating a negative air pressure (an air vacuum) located near an end of the transfer and metering rolls to evacuate wetting agent 170 in the nip as it approaches the end of the rolls 103 and 109.

As mentioned above, pump 165 supplies wetting agent 170 to nip 172 formed by rolls 103 and 109 through one or more tubes 162 thereby flooding the nip. Water pressure and gravitation tend to push wetting agent 170 towards the ends of the rolls 103 and 109. To prevent the wetting agent from leaking off the ends of the rolls, a differential pressure is generated between the ends of the nip 172 and the interior region of the nip by the application of a negative air pressure directed to the ends of the rolls through apertures (e.g., vacuum lines, tubes, hoses, nozzles, etc) 182 is placed at each end of the rolls. The negative air pressure could be created by a small vacuum pump 180 which would suction both wetting agent and air through line 182 and return the wetting agent to tank 160. As an alternative to the use of vacuum pump 180, the suction could be created by the use of an injector placed in the outlet line 162 of supply pump 165. This placement of the injector in the outlet line of supply pump 165 creates a venturi effect which will suction out the wetting agent by negative air pressure.

Wicks 150 can be pressed against the ends of the rolls 103 and 109 to further prevent leakage of wetting agent in the case of a loss of power to the system wherein the vacuum pressure is lost. Furthermore, wicks 150 can drain into a small cup 152 which itself can be drained back to tank 160 through tube 154. Beneficially, wicks 150 comprise a high density material, such as, cotton that contacts the ends of the rolls to absorb any wetting agent that may reach the ends of the rolls. This power loss strategy can also be used as a backup protection to prevent leakage from the rolls in the event that too much wetting agent is supplied to the nip or a vacuum line 182 becomes clogged with toner or paper particles.

Referring now to FIGS. 5 and 6 there is shown another embodiment of a conditioner roll seal in accordance with the present invention for sealing the rolls to prevent leakage of the wetting agent therefrom. The embodiment of FIGS. 5 and 6 creates a differential pressure between the ends of the nip and the interior region of the nip area through the use of directed air pressure applied to the ends of the rolls to counteract the pressure and gravitation which tend to push the wetting agent towards the ends of the rolls.

As mentioned above, pump 165 supplies wetting agent 170 to nip 172 formed by rolls 103 and 109 through one or more sources 162 such as a tube or the like thereby flooding the nip. Water pressure and gravitation tend to push wetting agent 170 towards the ends of the rolls 103 and 109. To prevent the wetting agent from leaking off the ends of the rolls, a differential pressure is generated between the ends of the nip 172 and the interior region of the nip by generating a positive air pressure at the ends of the rolls via apertures (e.g., air lines, tubes, hoses, nozzles, etc) 184 placed at each end of the rolls to counteract the forces which push the wetting agent towards the ends of the rolls. Relatively low air pressures (0.25–0.75 psi) and flow rates (0.1–0.2 cfm) are required to counteract the forces driving the wetting agent to the ends of the nip.

To further prevent leakage of wetting agent 170 and protect against overfill of nip 172 in the event that too much wetting agent is supplied to the nip, the conditioner can include a negative air pressure near the center of the nip. The negative air pressure could be created by a small vacuum pump 180 which would suction both wetting agent and air through line 182 and return the wetting agent to tank 160. As an alternative to the use of vacuum pump 180, the suction could be created by the use of an injector placed in the outlet line 162 of supply pump 165. This placement of the injector in the outlet line of supply pump 165 creates a venturi effect which will suction out the wetting agent by negative air pressure.

As was discussed above, wicks 150 can be pressed against the ends of the rolls 103 and 109 to further prevent leakage of wetting agent in the case of a loss of power to the system resulting in the loss of air pressure. Here again, the wicks beneficially comprise a high density material, such as, cotton that contacts the ends of the rolls to absorb any wetting agent that may reach the ends of the rolls. Additionally, wicks 150 can drain into small cups 152 which can be drained by the use of gravity to tank 160 through tube 154.

In summary, the present invention provides a system and method for sealing the ends of a conditioner assembly using differential air pressure. Although the present invention has been described in detail above, various modifications can be implemented without imparting from the spirit. For example, the present invention has been described with reference to the upper transfer/metering roll assembly; however, the system can also be used with the lower assembly. Furthermore, the present invention is not limited to use with a substrate conditioning system and can be applied to seal liquid within a nip for a variety of devices.

While the present invention has been described with reference to various embodiments disclosed above, it is not confined to the details to support the above, but is intended to cover such alternatives, modifications, and variations as may come within the scope of the attached claims.

What is claimed is:

1. A device for controlling leakage of liquid from a conditioning assembly, comprising:

a transfer roll, for applying liquid to a side of a sheet, the transfer roll having an outer cylindrical surface;

a metering roll, having an outer cylindrical surface in contact with the transfer roll, to control the flow of liquid to the transfer roll, the transfer and metering rolls being aligned with respect to one another along their axes so as to define a nip between the outer cylindrical surfaces;

a supply pump to supply liquid to the nip; and a nozzle positioned near an end of one of the transfer roll and metering roll, the nozzle generating an air pressure at the roll end.

2. The device according to claim 1, wherein the nozzle generates a negative air pressure.

3. The device according to claim 2, wherein the nozzle includes a vacuum hose connected to a vacuum pump.

4. The device according to claim 2, further comprising an outlet line connected to the supply pump and wherein one end of the nozzle is connected to the outlet line.

5. The device according to claim 1, further comprising a wick in contact with an end of the metering and transfer rolls to absorb liquid at the end of the rolls.

6. The device according to claim 1, wherein the nozzle generates a positive pressure.

7. The device according to claim 6, further comprising a vacuum hose generating negative pressure at a location remote from the roll end.

8. The device according to claim 7, wherein the supply pump further includes an outlet line and wherein the vacuum hose is connected to the outlet line.

9. A printing machine of the type wherein a sheet having indicia printed thereon advances through a conditioning system, the conditioning system comprising:

a pair of generally cylindrical rolls, the rolls being aligned with respect to one another along their axes so as to define a conditioner nip between the outer cylindrical surfaces, the pair of generally cylindrical rolls including a first roll adapted to drive a sheet in a first direction through the conditioner nip and a second roll, adapted to apply a liquid to a side of the sheet opposite the side that contacts the first roll;

a metering roll in contact with one roll of the pair of generally cylindrical rolls for forming a fluid nip therewith and controlling the amount of fluid supplied to the one of the pair of rolls;

a supply pump to supply liquid to the fluid nip; and a nozzle, positioned near an end of the fluid nip, to generate a pressure differential between the end of the nip and an interior of the nip.

10. The printing machine of claim 9, wherein the nozzle generates a negative pressure at the end of the nip.

11. The printing machine of claim 10 further comprising a vacuum source connected to the nozzle.

12. The printing machine of claim 9, further comprising a wick in contact with an end of one of the metering and transfer rolls to absorb liquid at the roll end.

13. The printing machine of claim 9, wherein the nozzle generates a positive pressure.

14. The printing machine of claim 13, further comprising a vacuum hose generating negative pressure to remove liquid from within the nip.

15. A method of controlling the amount of liquid within a nip formed between a metering roll and a transfer roll, comprising:

(a) supplying liquid to the nip; and (b) generating an air pressure at an end of the nip, the air pressure at the end of the nip being different than an air pressure at an interior of the nip.

16. The method of claim 15, wherein step (b) generates a positive pressure and further comprising:

(c) generating negative pressure within the interior of the nip to remove excess liquid from within the nip.

17. The method of claim 15, wherein step (b) generates a positive pressure at both ends of the nip.

18. The method of claim 15, wherein step (b) generates a negative pressure at both ends of the nip.

19. In a system for supplying a measured amount of liquid to a transfer roll wherein the liquid is supplied to a fluid reservoir defined by the area of contact between the transfer roll and a metering device through a fluid supply hose, the metering device controlling the amount of fluid supplied to the transfer roll, the improvement comprising:

a fluid sealing device for sealing the liquid within the fluid reservoir, said sealing device comprising a nozzle positioned at an end of the fluid reservoir, said nozzle generating a first pressure at the end of the fluid reservoir.

20. The system with a fluid sealing device of claim 19, wherein the nozzle generates a negative pressure at the end of the fluid reservoir.

21. The system with a fluid sealing device of claim 20, wherein an end of the nozzle is operatively connected to the fluid supply hose to generate the negative pressure.

22. The system with a fluid sealing device of claim 19, wherein the nozzle generates a positive pressure at the end of the fluid reservoir.

23. The system with a fluid sealing device of claim 19, further comprising a second nozzle, the second nozzle positioned at a location removed from the end of the fluid reservoir, the second nozzle generating a negative pressure.

* * * * *